US010677272B2

(12) United States Patent
Saitoh et al.

(10) Patent No.: US 10,677,272 B2
(45) Date of Patent: Jun. 9, 2020

(54) CONSTRUCTION MACHINE

(71) Applicant: Hitachi Construction Machinery Co., Ltd., Taito-ku, Tokyo (JP)

(72) Inventors: Teppei Saitoh, Tokyo (JP); Juri Shimizu, Tsuchiura (JP); Kenji Hiraku, Tsuchiura (JP); Hiromasa Takahashi, Tsuchiura (JP); Shouhei Sugiki, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 110 days.

(21) Appl. No.: 16/084,882

(22) PCT Filed: Jun. 26, 2017

(86) PCT No.: PCT/JP2017/023416
§ 371 (c)(1),
(2) Date: Sep. 13, 2018

(87) PCT Pub. No.: WO2018/012264
PCT Pub. Date: Jan. 18, 2018

(65) Prior Publication Data

US 2019/0078594 A1 Mar. 14, 2019

(30) Foreign Application Priority Data

Jul. 15, 2016 (JP) ..... 2016-140046

(51) Int. Cl.
*F15B 20/00* (2006.01)
*E02F 9/24* (2006.01)
(Continued)

(52) U.S. Cl.
CPC ..... *F15B 20/008* (2013.01); *E02F 9/22* (2013.01); *E02F 9/2228* (2013.01); *E02F 9/24* (2013.01);
(Continued)

(58) Field of Classification Search
CPC ..... E02F 9/226; F15B 11/17; F15B 13/023; F15B 20/004; F15B 20/008
See application file for complete search history.

(56) References Cited

U.S. PATENT DOCUMENTS 3,426,792 A * 2/1969 Wood ..... F15B 20/008 137/596.12
2005/0132877 A1* 6/2005 Hart ..... F15B 13/0403 91/509
(Continued)

FOREIGN PATENT DOCUMENTS

JP 2008-291962 12/2008
JP 2009-121649 A 6/2009
(Continued)

OTHER PUBLICATIONS

Notification of Transmittal of Translation of the International Preliminary Report on Patentability (PCT/IB/338 & PCT/IB/373) issued in PCT Application No. PCT/JP2017/023416 dated Jan. 24, 2019, including English translation of document C2 (Japanese-language Written Opinion (PCT/ISA/237 previously filed on Sep. 13, 2018)) (seven (7) pages).
(Continued)

*Primary Examiner* — Michael Leslie
*Assistant Examiner* — Matthew Wiblin
(74) *Attorney, Agent, or Firm* — Crowell & Moring LLP

(57) ABSTRACT

Provided is a construction machine capable of detecting a stuck-open state of a surplus flow control valve in real time during operation without involving a reduction in the operational speed. The construction machine is equipped with: a surplus flow control valve control section configured to output a closing command to a first surplus flow control valve at the operation start when an operation amount signal of an operation lever device is detected; a pump delivery control section configured to output a delivery flow rate
(Continued)

command to an adjustment section of an open circuit pump; an assist valve control section configured to continue to output a closing command from before to an assist valve; a sticking detection determination section configured to compare a pressure signal with a previously set threshold value and determining that the surplus flow control valve is in a stuck-open state when the pressure signal is less than the threshold value and determining that the surplus flow control valve is normal when the pressure signal exceeds the threshold value; and a stop signal generating section configured to input therein a sticking determination signal, output in the case of a stuck-open state a control signal maintaining a closed state of the assist valve to the assist valve control section, and output in the case of a normal state a control signal causing the assist valve to perform an opening operation to the assist valve control section.

3 Claims, 10 Drawing Sheets

(51) Int. Cl.

| | |
|---|---|
| ***F15B 11/02*** | (2006.01) |
| ***F15B 11/08*** | (2006.01) |
| ***E02F 9/22*** | (2006.01) |

(52) U.S. Cl.
CPC ..... *F15B 11/02* (2013.01); *F15B 11/08* (2013.01); *F15B 20/00* (2013.01); *F15B 20/004* (2013.01); *F15B 2211/255* (2013.01); *F15B 2211/4053* (2013.01)

(56) References Cited

U.S. PATENT DOCUMENTS

| | | | | |
|---|---|---|---|---|
| 2007/0169474 | A1* | 7/2007 | Oka | F15B 11/17 60/486 |
| 2013/0098020 | A1* | 4/2013 | Opdenbosch | F15B 7/006 60/327 |
| 2013/0098024 | A1* | 4/2013 | Knussman | E02F 9/2242 60/420 |
| 2013/0312399 | A1* | 11/2013 | Hiraku | F15B 15/18 60/422 |
| 2014/0007565 | A1* | 1/2014 | Yamashita | E02F 9/128 60/431 |
| 2014/0345265 | A1* | 11/2014 | Akiyama | F15B 11/17 60/418 |
| 2015/0135697 | A1* | 5/2015 | Shimizu | E02F 9/2235 60/425 |
| 2015/0292526 | A1* | 10/2015 | Saitoh | E02F 9/2289 60/477 |
| 2016/0032565 | A1 | 2/2016 | Shimizu et al. | |
| 2017/0016208 | A1* | 1/2017 | Saitoh | E02F 9/22 |
| 2017/0198731 | A1 | 7/2017 | Sugano | |

FOREIGN PATENT DOCUMENTS

| | | |
|---|---|---|
| JP | 2015-48899 A | 3/2015 |
| JP | 2016-35321 A | 3/2016 |

OTHER PUBLICATIONS

International Search Report (PCT/ISA/210) issued in PCT Application No. PCT/JP2017/023416 dated Sep. 26, 2017 with English translation (three (3) pges).
Japanese-language Written Opinion (PCT/ISA/237) issued in PCT Application No. PCT/JP2017/023416 dated Sep. 26, 2017 (four (4) pages).

* cited by examiner

CONSTRUCTION MACHINE

TECHNICAL FIELD

The present invention relates to a construction machine.

BACKGROUND ART

In the field of a construction machine such as a hydraulic excavator, there exists a closed circuit hydraulic drive system in which, in order to achieve energy saving for the hydraulic system, a both-way tilting hydraulic pump (hereinafter also referred to as the closed circuit pump) and a hydraulic actuator are connected to each other in a closed-circuit-like fashion and in which the drive speed of the hydraulic actuator is controlled through delivery flow rate control of the both-way tilting hydraulic pump to return the return fluid from the hydraulic actuator to the closed circuit pump (see, for example, Patent Document 1).

There is a failure diagnosis device detecting sticking failure of a hydraulic proportional valve (hereinafter also referred to as the proportional valve) used in hydraulic devices in general (see, for example, Patent Document 2). This failure diagnosis device for the proportional valve is a failure diagnosis device for the proportional valve of a vehicle hydraulic device having a pump, accumulator, and proportional valve, and is equipped with proportional valve drive direction means for outputting a proportional valve direct current for driving the proportional valve, pressure measurement means for measuring the pump pressure of the pump, and proportional valve sticking determination means for making sticking determination of the proportional valve based on the proportional valve direct current and the pump pressure. The proportional valve sticking determination means has first pressure storage means storing the pump pressure when the pump stops, second pressure storage means storing the pump pressure when a predetermined period of time has elapsed since the stopping of the pump, and first pressure difference calculation means calculating the difference between the pump pressure stored in the first pressure storage means and the pump pressure stored in the second pressure storage means; and in the case where when the pump is stopped and "close" direction is given to the proportional valve after increasing the pressure through the operation of the pump for a predetermined period of time, the difference in the pump pressure calculated by the first pressure difference calculation means is equal to or more than a predetermined value, it is determined that the proportional valve suffers from stuck-open failure.

PRIOR ART DOCUMENT

Patent Document

Patent Document 1: JP-2015-048899-A
Patent Document 2: JP-2008-291962-A

SUMMARY OF THE INVENTION

Problem to be Solved by the Invention

In the closed circuit hydraulic drive system described in Patent Document 1 mentioned above, in the case where the hydraulic actuator is a one-rod hydraulic cylinder, the head fluid chamber side pressure portion and the rod fluid chamber side pressure receiving portion of the piston differ in area, so that the amount of working fluid flowing into the hydraulic cylinder differs from the amount of working fluid flowing out of the hydraulic cylinder with the operation of the piston. As a result, inside the closed circuit, there are generated a portion where there is an excessive amount of working fluid and a portion where there is a shortage of working fluid.

In order to suppress such excess/shortage of working fluid inside the closed circuit, there is connected to the head fluid chamber side of the hydraulic cylinder a one-side tilting hydraulic pump (hereinafter referred to as the open circuit pump) supplying shortage working fluid via a selector valve, and, between the open circuit pump and the selector valve, there is provided a hydraulic proportional valve making it possible to discharge surplus working fluid to a tank. This hydraulic proportional valve is referred to as the surplus flow control valve.

For example, in the case where one hydraulic cylinder is driven in the expanding direction, the selector valve is opened to supply working fluid to the hydraulic cylinder head fluid chamber side from the open circuit pump as well as from the closed circuit pump, with the return fluid from the hydraulic cylinder rod fluid chamber side being sucked by the closed circuit pump. At this time, the surplus flow control valve is closed. On the other hand, in the case where the hydraulic cylinder is driven in contracting direction, working fluid is supplied to the hydraulic cylinder rod fluid chamber side from the closed circuit pump, with the return fluid from the hydraulic cylinder head fluid chamber side being sucked by the closed circuit. At this time, the selector valve and the surplus flow control valve are opened to discharge the return fluid from the hydraulic cylinder head fluid chamber side to the tank. At this time, the open circuit pump delivers no working fluid.

In the surplus flow control valve constituting this hydraulic drive system, when, for example, the valve is stuck open to cause the inner line to remain open, the hydraulic fluid in the hydraulic cylinder is allowed to be discharged into the tank via the surplus flow control valve stuck open. As a result, there is generated the possibility of the hydraulic cylinder operating abruptly in an unintended direction, deteriorating the operability of the construction machine.

In the proportional valve failure diagnosis device disclosed in Patent Document 2, it is necessary to temporarily stop the device, and to give direction to stop the pump and to "close" the proportional valve. In the case where the failure diagnosis device of Patent Document 2 is applied to the work machine (construction machine) disclosed in Patent Document 1, in order to determine the stuck-open state of the surplus flow control valve, it is necessary to temporarily stop the device to close the selector valve, to start the open circuit pump, and to measure the pressure value of the open circuit pump generated when the surplus flow control valve is closed for the stuck-open state determination. Thus, all this while, it is impossible to drive the hydraulic cylinder by the open circuit pump, and the work by the construction machine needs to be stopped. This results in a reduction in the work speed of the machine as a whole and deterioration in productivity.

The present invention has been made in view of the above problem. It is an object of the present invention to provide a construction machine capable of detecting a stuck-open state of the surplus flow control valve in real time during operation without involving a reduction in the operational speed of the construction machine.

Means for Solving the Problem

To achieve the above object, there is adopted, for example, the structure as described in the appended claims.

The present application includes a plurality of means for solving the above problem, an example of which is a construction machine including: a first closed circuit unit equipped with a first closed circuit pump, and a first hydraulic cylinder connected to the first closed circuit pump in a closed-circuit-like fashion; a first open circuit unit equipped with a first open circuit pump connected to a head fluid chamber side line of the first hydraulic cylinder via a first assist valve that is a selector valve, and a first surplus flow control valve arranged in a line branching off from a first open circuit pump delivery side line that is a line between the first open circuit pump and the first assist valve, the first surplus flow control valve enabling a working fluid from a head fluid chamber of the first hydraulic cylinder to be discharged into a tank; and a control unit equipped with a first operation lever device directing an operation of the first hydraulic cylinder, a first pressure sensor measuring a pressure of the first open circuit pump delivery side line, a plurality of adjustment sections each adjusting delivery flow rates of the first closed circuit pump and the first open circuit pump, and a controller outputting command signals to the first surplus flow control valve, the first assist valve, and the plurality of adjustment sections. The controller is equipped with: a pressure detection section configured to take in a first pressure signal of the first open circuit pump delivery side line measured by the first pressure sensor; an operation amount detection section configured to take in an operation amount signal from the first operation lever device; a surplus flow control valve control section configured to output a closing command to the first surplus flow control valve at an operation start when the operation amount detection section detects an operation amount signal of the first operation lever device; a pump delivery control section configured to output a delivery flow rate command to the adjustment section of the first open circuit pump at the operation start; an assist valve control section configured to output a closing command to the first assist valve at the operation start; a sticking detection determination section configured to compare a first pressure signal from the pressure detection section with a previously set threshold value and determining that the first surplus flow control valve is in a stuck-open state when the first pressure signal is less than the threshold value and determining that the first surplus flow control valve is normal when the first pressure signal exceeds the threshold value; and a stop signal generating section configured to input therein a sticking determination signal from the sticking detection determination section, output in a case of a stuck-open state a control signal maintaining a closed state of the first assist valve to the assist valve control section, and output in a case of a normal state a control signal causing the first assist valve to perform an opening operation to the assist valve control section.

Effect of the Invention

According to the present invention, it is possible to detect a stuck-open state of a surplus flow control valve in real time during operation of a construction machine, so that it is possible to suppress a reduction in operational efficiency.

MODES FOR CARRYING OUT THE INVENTION

Figure 1:
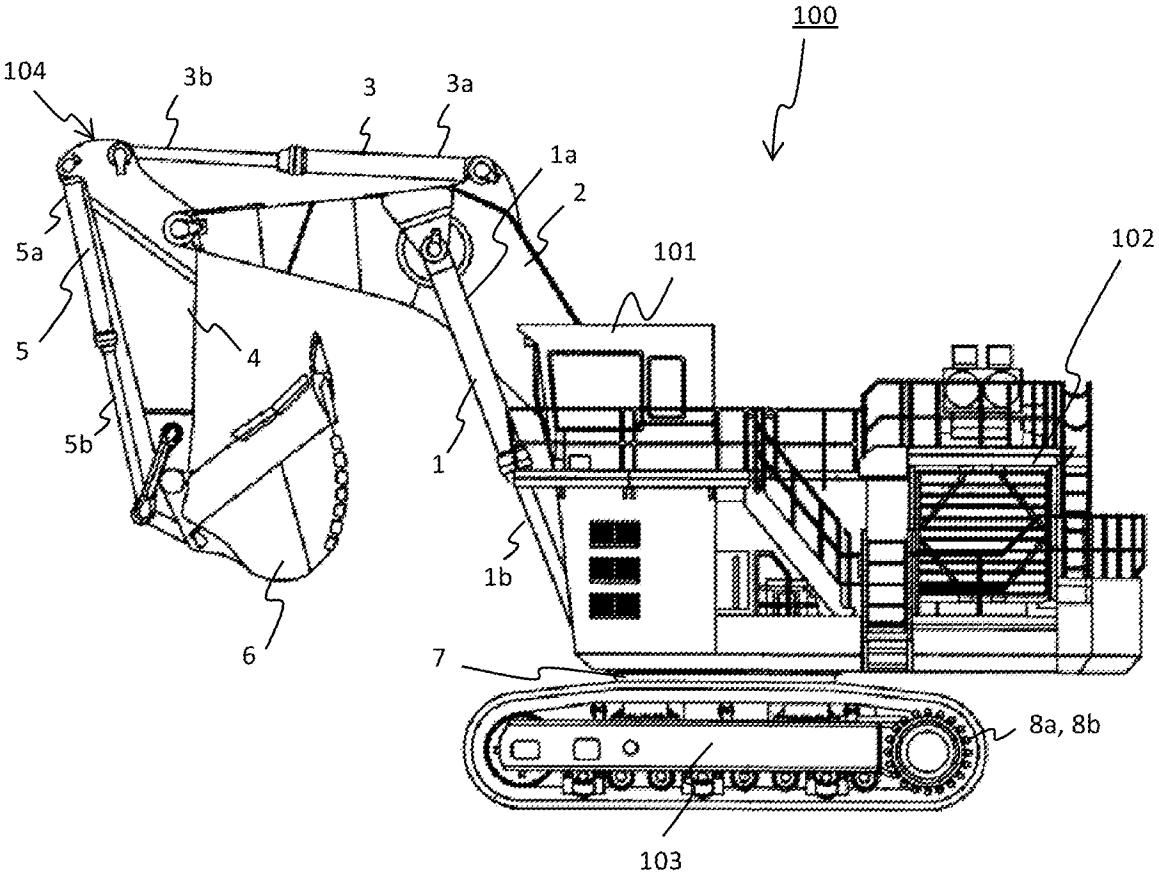
FIG. 1 is a side view of a hydraulic excavator according to a first embodiment of the construction machine of the present invention.

In the following, embodiments of the present invention will be described, taking a hydraulic excavator as an example of the construction machine. The present invention is applicable not only to a hydraulic excavator but also to a construction machine in general that is equipped with a hydraulic cylinder connected to a closed circuit pump in a closed-circuit-like fashion, an open circuit pump connected to a head fluid chamber side of a hydraulic cylinder, and a surplus flow control valve.

In a hydraulic cylinder drive circuit based on a closed circuit using a conventional surplus flow control valve, when the surplus flow control valve is in a stuck-open state, the working fluid on the hydraulic cylinder head fluid chamber side is discharged into a tank, with the result that the hydraulic cylinder performs an unintended contracting operation.

In view of this, in a first embodiment of the present invention, a construction machine includes: a first closed circuit unit equipped with a first closed circuit pump, and a first hydraulic cylinder connected to the first closed circuit pump in a closed-circuit-like fashion; a first open circuit unit equipped with a first open circuit pump connected to a head fluid chamber side of the first hydraulic cylinder via a first assist valve that is a selector valve, and a first surplus flow control valve arranged between the first open circuit pump and the first assist valve and enabling a surplus hydraulic fluid from a head fluid chamber side of the first hydraulic cylinder to be discharged into a tank; and a control unit equipped with a first operation lever device directing an operation of the first hydraulic cylinder, a controller equipped with a pump delivery control section, an assist valve control section, and a surplus flow control valve control section, and a pressure sensor provided in the first open circuit pump delivery side line and measuring the delivery pressure of the first open circuit pump.

When the first hydraulic cylinder expansion signal due to the first operation lever device is input, the controller outputs a closing command to the first surplus flow control valve before outputting an opening command to the first assist valve, and closes the first surplus flow control valve. Then, it increases the delivery flow rate of the first open circuit pump, so that the delivery pressure signal of the first open circuit pump being input increases. In the case where the increase amount of the delivery pressure signal is equal to or less than a previously determined threshold value, the controller determines that the first surplus flow control valve is stuck open. Having determined that the first surplus flow control valve is stuck open, the controller prohibits the output of an opening command to the first assist valve, and maintains the closed state of the first assist valve.

As a result, it is possible to detect the stuck-open state of the surplus flow control valve in real time during the operation of the construction machine. As a result, it is possible to suppress a reduction in availability factor. Further, when the stuck-open state of the surplus flow control valve is detected, the assist valve is closed, so that it is possible to suppress an unintended contracting operation of the hydraulic cylinder, making it possible to provide a construction machine in which a front work device operation unintended by the operator is further suppressed.

Embodiment 1

Figure 2:
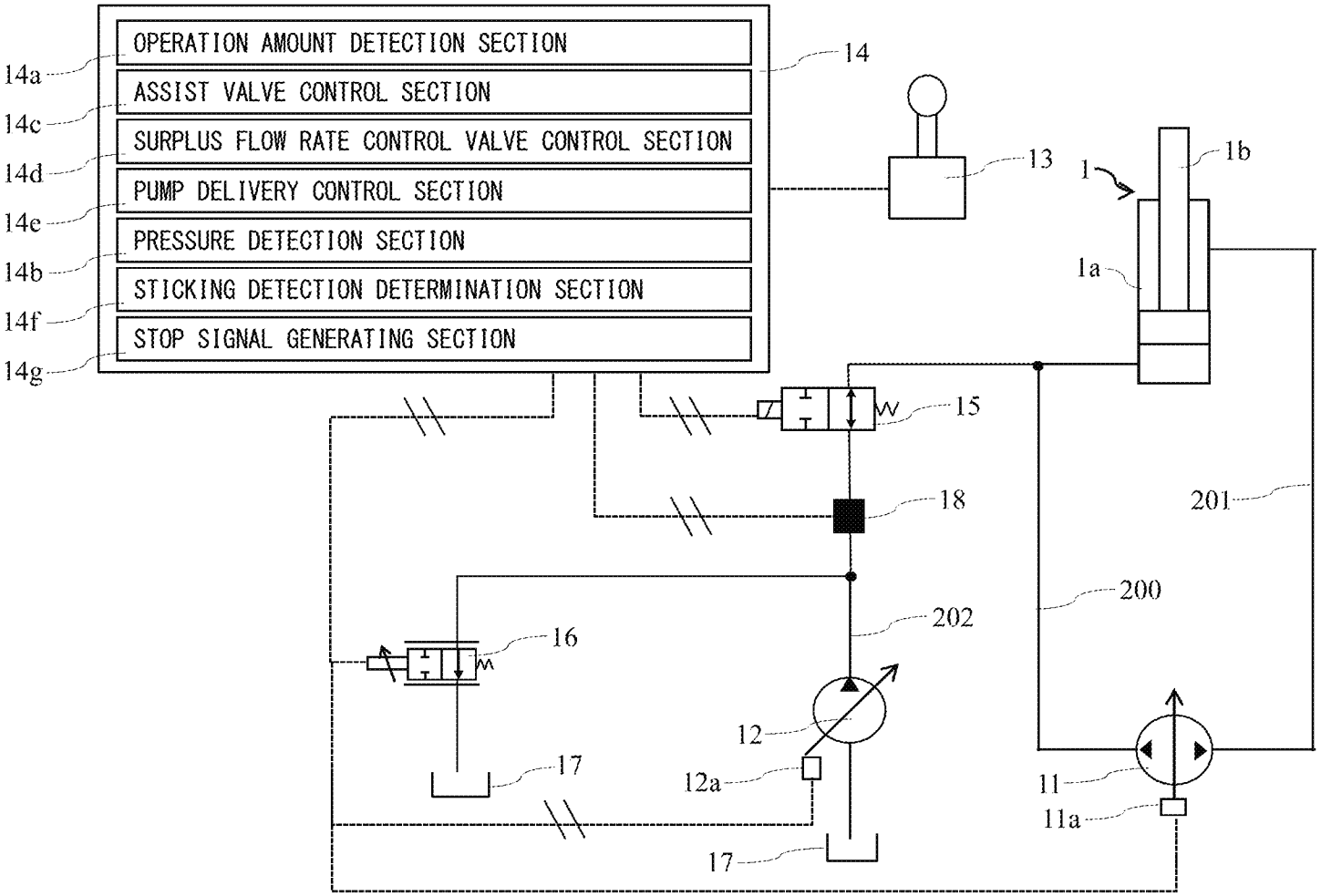
FIG. 2 is a schematic drawing illustrating a hydraulic drive system constituting the first embodiment of the construction machine of the present invention.

FIG. 1 is a side view of a hydraulic excavator according to a first embodiment of the construction machine of the present invention, and FIG. 2 is a schematic drawing illustrating a hydraulic drive system constituting the first embodiment of the construction machine of the present invention.

Referring to FIG. 1, a hydraulic excavator 100 will be described as an example of a construction machine according to the present embodiment. The hydraulic excavator 100 is equipped with a lower track structure 103 equipped with crawler type track devices 8*a* and 8*b* on both sides in the right-left direction, and an upper swing structure 102 as a machine body swingably mounted on top of the lower track structure 103. The upper swing structure 102 is provided with a cab 101 as an operation chamber boarded by the operator. The lower track structure 103 and the upper swing structure 102 are swingable via a swing hydraulic motor 7.

The proximal end portion of a front work device 104 which is a work device for performing, for example, an excavation work is rotatably mounted to the front side of the upper swing structure 102. Here, the front side refers to the direction in which the operator boarding the cab 101 faces (the left direction in FIG. 1).

The front work device 104 is provided with a boom 2 the proximal end portion of which is connected to the front side of the upper swing structure 102 so as to be capable of boom hoisting. The boom 2 operates via a boom cylinder 1 which is a one-rod type hydraulic cylinder driven by a working fluid (hydraulic fluid) as the fluid supplied. In the boom cylinder 1, the distal end portion of a boom rod 1*b* is connected to the upper swing structure 102, and the proximal end portion of a boom head 1*a* is connected to the boom 2.

Connected to the distal end portion of the boom 2 is the proximal end portion of an arm 4 so as to be capable of hoisting. The arm 4 operates via an arm cylinder 3 which is a one-rod type hydraulic cylinder. In the arm cylinder 3, the distal end portion of an arm rod 3*b* is connected to the arm 4, and an arm head 3*a* of the arm cylinder 3 is connected to the boom 2.

Connected to the distal end portion of the arm 4 is the distal end portion of a bucket 6 so as to be capable of hoisting. The bucket 6 operates via a bucket cylinder 5 which is a one-rod type hydraulic cylinder as the hydraulic actuator driven by the working fluid supplied. In the bucket cylinder 5, the distal end portion of a bucket rod 5*b* is connected to a bucket 6, and the proximal end of a bucket head 5*a* of the bucket cylinder 5 is connected to the arm 4.

Arranged in the cab 101 is a first operation lever device 13 (see FIG. 2) which is an operation member for operating the boom 2, the arm 4, and the bucket 6 constituting the front work device 104.

Next, the system configuration of the hydraulic drive system shown in the schematic drawing of FIG. 2 will be described.

Each of a first closed circuit pump 11 and a first open circuit pump 12 driven by power from an engine (not shown) is equipped with, as flow rate adjustment means, a tilting swash plate mechanism having a pair of input/output and regulators 11*a* and 12*a* which adjust the tilting angle of the swash plate to adjust the pump displacement volume. The regulators 11*a* and 12*a* respectively control the delivery flow rates of the first closed circuit pump 11 and the first open circuit pump 12 in accordance with a pump delivery flow rate command value received from a controller 14 via a signal line.

One delivery port of the first closed circuit pump 11 is connected to the rod fluid chamber side of the boom cylinder 1 as the first hydraulic cylinder via a line 201, and the other delivery port of the first closed circuit pump 11 is connected to the head fluid chamber side of the boom cylinder 1 via a line 200, thus constituting a closed circuit. In the present embodiment, the first closed circuit pump 11 and the boom cylinder 1 connected to the closed circuit constitute a first closed circuit unit.

The delivery port of the first open circuit pump 12 is connected to a line 200 via a line 202 and a first assist valve 15 which is a selector valve. The suction port of the first open circuit pump 12 is connected to a tank 17.

In the line 202 between the first open circuit pump 12 and the first assist valve 15, there is provided a branching portion, and connected to this branching portion is one end side of a line 203 the other end side of which is connected to the tank 17. In the line 203, there is provided a first surplus flow control valve 16 which is a hydraulic proportional valve. The opening/closing of each of the first assist valve 15 and the first surplus flow control valve 16 is controlled in accordance with a command signal received from the controller 14 via a signal line. In the present embodiment, the first open circuit pump 12, the first assist valve 15, and the first surplus flow control valve 16 constitute a first open circuit unit.

In the line 202, there is provided a first pressure sensor 18 measuring the delivery pressure of the first open circuit pump 12. The delivery pressure signal of the first open circuit pump 12 detected by the first pressure sensor 18 is inputted to the controller 14 via a signal line. An operation signal of the first operation lever device 13 due to the operator is inputted to the controller 14 via a signal line. In the present embodiment, the first operation lever device 13, the first pressure sensor 18, the regulators 11*a* and 12*a*, and the controller 14 constitute the control unit.

Figure 3:
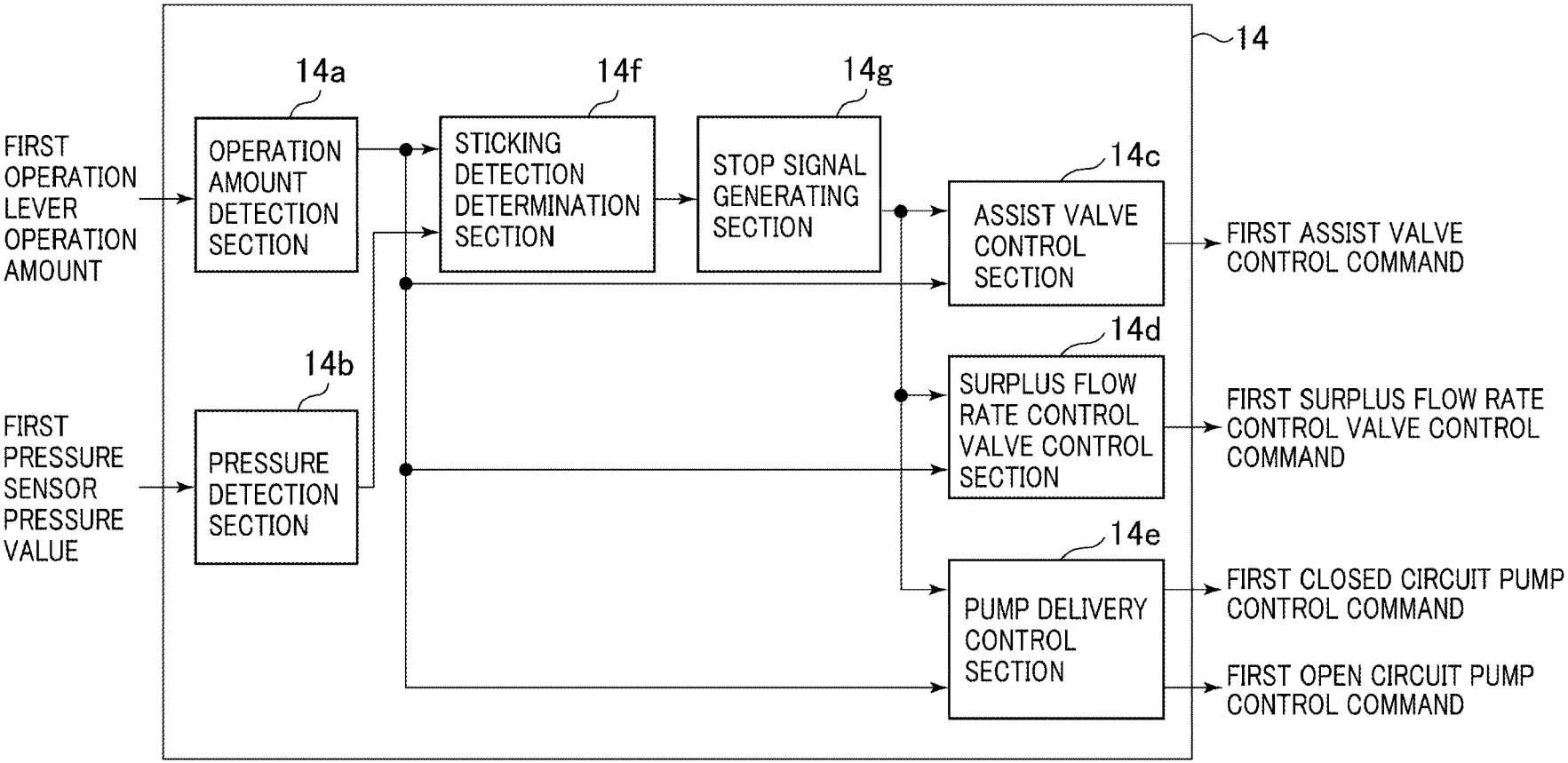
FIG. 3 is a conceptual drawing illustrating the structure of a controller constituting the first embodiment of the construction machine of the present invention.
Figure 4:
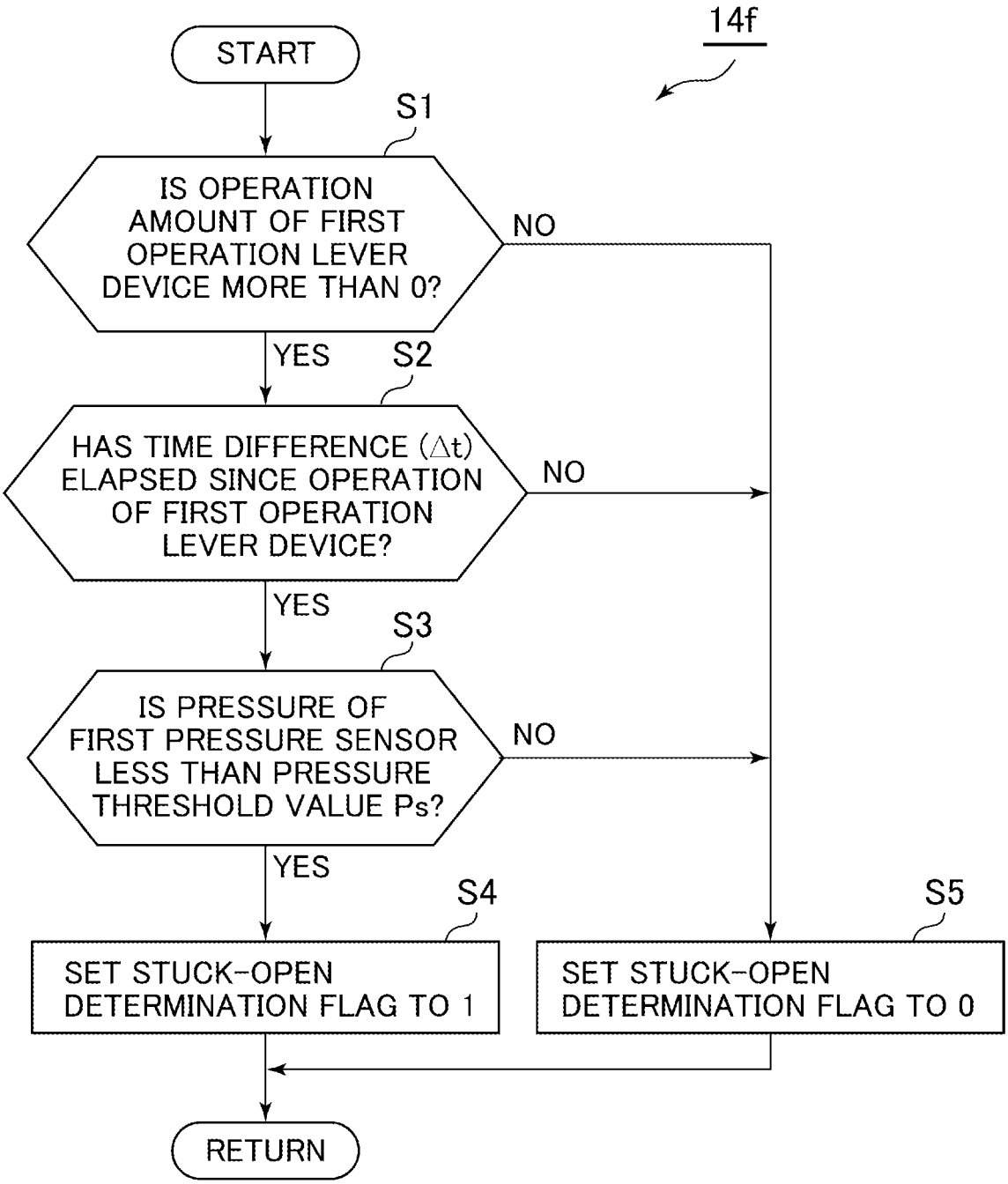
FIG. 4 is a flowchart illustrating the processing of a sticking detection determination section of the controller constituting the first embodiment of the construction machine of the present invention.

Next, the controller 14 constituting the present embodiment will be described with reference to FIGS. 3 and 4. FIG.

3 is a conceptual drawing illustrating the structure of a controller constituting the first embodiment of the construction machine of the present invention. FIG. 4 is a flowchart illustrating the processing of a sticking detection determination section of the controller constituting the first embodiment of the construction machine of the present invention.

The controller 14 inputs an operation signal of the first operation lever device 13 and a delivery pressure signal of the first open circuit pump 12 of the first pressure sensor 18, and controls the first assist valve 15 and the first surplus flow control valve 16 in accordance with these signals. It determines the presence/absence of the stuck-open state of the first surplus flow control valve, and respectively controls the delivery flow rates of the first closed circuit pump 11 and the first open circuit pump 12. As shown in FIG. 3, the controller 14 is equipped with an operation amount detection section 14*a*, a pressure detection section 14*b*, an assist valve control section 14*c*, a surplus flow control valve control section 14*d*, a pump delivery control section 14*e*, a sticking detection determination section 14*f*, and a stop signal generating section 14*g*.

The operation amount detection section 14*a* inputs an operation amount signal from the first operation lever device 13, and outputs it to the sticking detection determination section 14*f* and the control sections 14*c*, 14*d*, and 14*e* as an expansion drive command value amount or a contraction drive command value amount of the boom cylinder 1.

The pressure detection section 14*b* inputs the delivery pressure signal of the first open circuit pump 12 from the first pressure sensor 18, and outputs it to the sticking detection determination section 14*f* as the pressure signal of the line 202.

The assist valve control section 14*c* and the surplus flow control valve control section 14*d* input the signal of the expansion drive command value amount or the contraction drive command value amount of the boom cylinder 1 from the operation amount detection section 14*a*, and in the case where the first surplus flow control valve 16 is determined to be stuck open, input a stop signal described below from the stop signal generating section 14*g*, outputting a control command signal to the first assist valve 15 and the first surplus flow control valve 16 in accordance with these signals.

More specifically, each of the assist valve control section 14*c* and the surplus flow control valve control section 14*d* is equipped, for example, with a table previously set based on the expansion drive command value amount or the contraction drive command value amount from the operation amount detection section 14*a*. In the case where the stop signal from the stop signal generating section 14*g* is not input, they compute a control command signal in accordance with these tables and output the same.

When the expansion drive command value amount or the contraction drive command value amount from the operation amount detection section 14*a* becomes larger than 0, that is, when the first operation lever device 13 is operated (at the time of operation start), the surplus flow control valve control section 14*d* immediately outputs a closing signal as a control command value to the first surplus flow control valve 16. On the other hand, when the expansion drive command value amount or the contraction drive command value amount from the operation amount detection section 14*a* becomes larger than 0, that is, when the first operation lever device 13 is operated (at the time of operation start), the assist valve control section 14*c* continues to output the closing signal as before as the control command value to the first assist valve 15. After a predetermined time difference (Δt) has elapsed from the time of operation start, it outputs a totally opening signal as the control command value to the first assist valve 15.

The pump delivery control section 14*e* inputs the signal of the expansion drive command value amount or the contraction drive command value amount for the boom cylinder 1 from the operation amount detection section 14*a*, and, in the case where the first surplus flow control valve 16 is determined to be stuck open, inputs the stop signal described below from the stop signal generating section 14*g*. In accordance with these signals, it computes control command signals respectively controlling the delivery flow rates of the first closed circuit pump 11 and the first open circuit pump 12, outputting the control command signals respectively to the regulators 11*a* and 12*a*.

When the expansion drive command value amount or the contraction drive command value amount from the operation amount detection section 14*a* is larger than 0, that is, when the first operation lever device 13 is operated (at the time of operation start), the pump delivery control section 14*e* immediately outputs control command signals respectively controlling the delivery flow rate of the first closed circuit pump 11 and that of the first open circuit pump 12.

The sticking detection determination section 14*f* is endowed with a function by which it detects the stuck-open state of the first surplus flow control valve 16. More specifically, with a predetermined timing, a previously determined pressure threshold value and the pressure signal of the line 202 from the pressure detection section 14*b* are compared with each other. In the case where the pressure signal is equal to or less than the threshold value, the first surplus flow control valve 16 is determined to be in the stuck-open state, and a stuck-open state determination flag is outputted to the stop signal generating section 14*g*.

Here, the operation of the controller 14 will be described. When, through the operation of the first operation lever device 13 by the operator, the expansion drive command value amount or the contraction drive command value amount from the operation amount detection section 14*a* becomes larger than 0 (at the time of operation start), that is, when the first operation lever device 13 is operated, the surplus flow control valve control section 14*d* immediately outputs a totally closing signal as the control command value to the first surplus flow control valve 16. At this time, the pump delivery control section 14*e* immediately outputs control command signals respectively controlling the delivery flow rate of the first closed circuit pump 11 and that of the first open circuit pump 12. At this time, the first assist valve 15 also receives a totally closing command, and has not received an opening command signal yet. Thus, in the schematic diagram of FIG. 2, the hydraulic fluid from the first open circuit pump 12 flows into the line 202. However, the first assist valve 15 and the first surplus flow control valve 16 are in the closed state, so that the pressure of the line 202 measured by the first pressure sensor 18 is expected to be increased. After the predetermined time difference (Δt) has elapsed, an opening command is outputted to the first assist valve 15, and the first open circuit pump 12 is connected to the boom cylinder. Thus, in the case where the pressure of the line 202 is equal to or less than the predetermined threshold value during this predetermined time difference (Δt), it is determined that the first surplus flow control valve 16 is stuck open.

In the case where the stuck-open state determination flag of the first surplus flow control valve 16 is input from the sticking detection determination section 14*f*, the stop signal generating section 14*g* generates stop signals and output them to the respective control sections. For example, a signal closing the first assist valve 15 is outputted to the assist valve control section 14*c*, and a signal reducing the delivery command value of the first open circuit pump 12 to 0 is outputted to the pump delivery control section 14*e*, with the line 202 being interrupted from the boom cylinder 1. As a result, it is possible to prevent the working fluid from being discharged from the boom head 1*a* of the boom cylinder 1 into the tank 17 via the first surplus flow control valve 16. As a result, it is possible to prevent abrupt contraction of the boom cylinder 1.

Next, the processing of the sticking detection determination section 14*f* will be described with reference to FIG. 4.

The sticking detection determination section 14*f* determines whether or not the operation amount of the first operation lever device 13 is larger than 0 (step S1). More specifically, it is determined whether or not the expansion drive command value amount or the contraction drive command value amount from the operation amount detection section 14*a* has become larger than 0 (whether or not the first operation lever device 13 has been operated), and the operation start time is specified. In the case where the operation amount is larger than 0, the procedure advances to step S2. Otherwise, the procedure advances to step S5.

The sticking detection determination section 14*f* determines whether or not the predetermined time difference (Δt) has elapsed since the operation of the first operation lever device 13 (at the time of operation start) (step S2). In the case where the predetermined time difference (Δt) has not elapsed, the procedure advances to step S3. Otherwise, the procedure advances to step S5.

The sticking detection determination section 14*f* determines whether or not the pressure measured by the first pressure sensor 18 is less than the previously set threshold value Ps (step S3). More specifically, it determines whether or not the pressure signal of the line 202 which is the delivery pressure of the first open circuit pump 12 from the pressure detection section 14*b* is less than the previously determined pressure threshold value Ps. In the case where the measured pressure is less than the threshold value Ps, the procedure advances to step S4. Otherwise, the procedure advances to step S5.

The sticking detection determination section 14*f* sets the stuck-open state determination flag to 1 (step S4). More specifically, in the case where the above steps S1 through S3 are all YES, that is, when the first operation lever device 13 has been operated (step S1), when the time having elapsed is within the predetermined time difference (Δt) (step S2), and when the pressure value measured by the first pressure sensor 18 is less than the threshold value Ps, the sticking detection determination section 14*f* sets the stuck-open state determination flag to 1, and determines that the first surplus flow control valve 16 is stuck open.

On the other hand, in the case where the result of one of the above steps S1 through S3 is NO, the sticking detection determination section 14*f* sets the stuck-open state determination flag to 0 (step S5). When it is 1, the stuck-open state determination flag indicates the stuck-open state, and when it is 0, it indicates the normal state.

After the completion of the processing of step S4 or step S5, the procedure of the sticking detection determination section 14*f* advances to RETURN, with the next procedure being executed starting from step 1.

Figure 5:
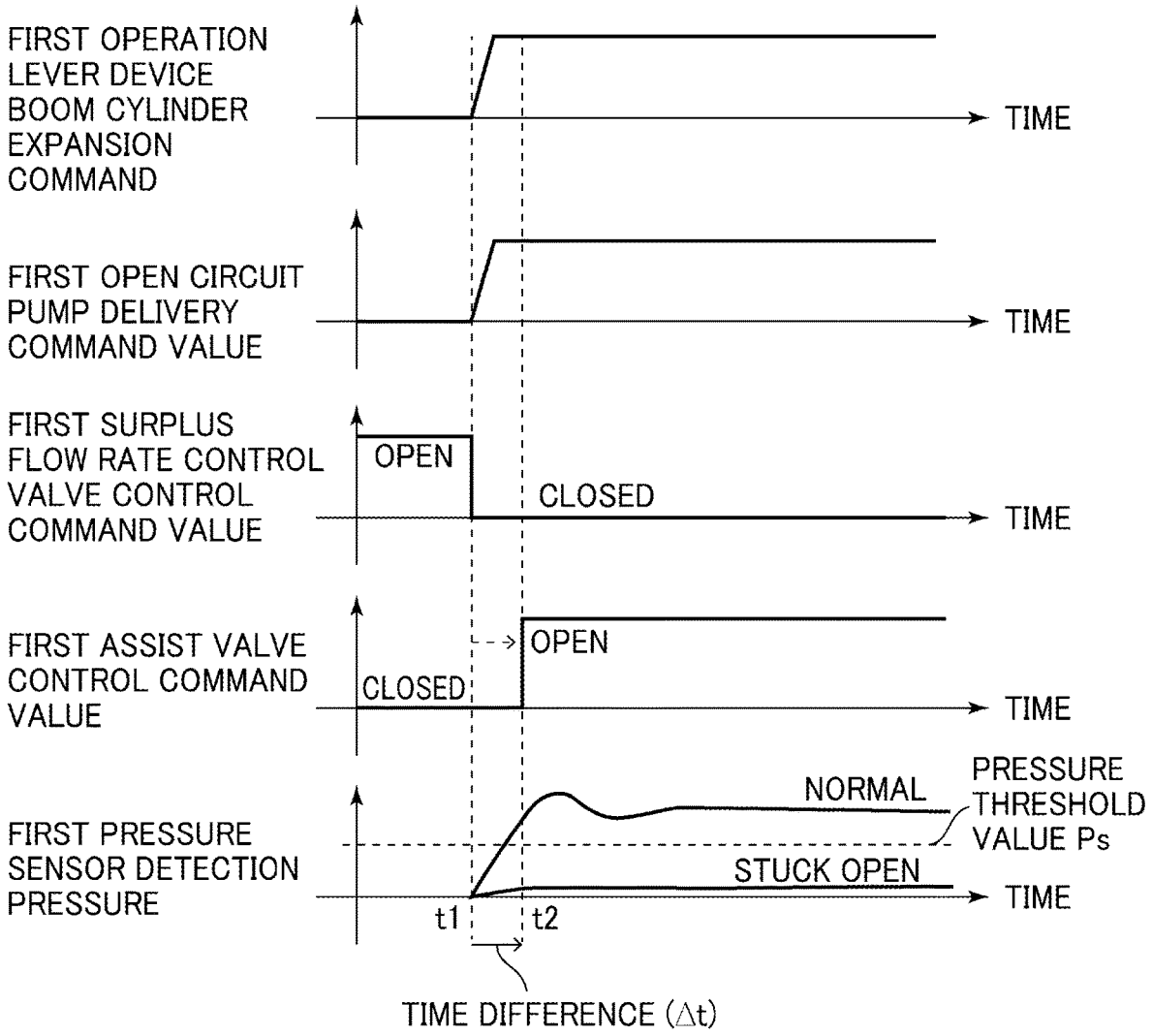
FIG. 5 is a characteristic chart illustrating an example of a chronological operation when a boom cylinder according to the first embodiment of the construction machine of the present invention performs an expanding operation.
Figure 6:
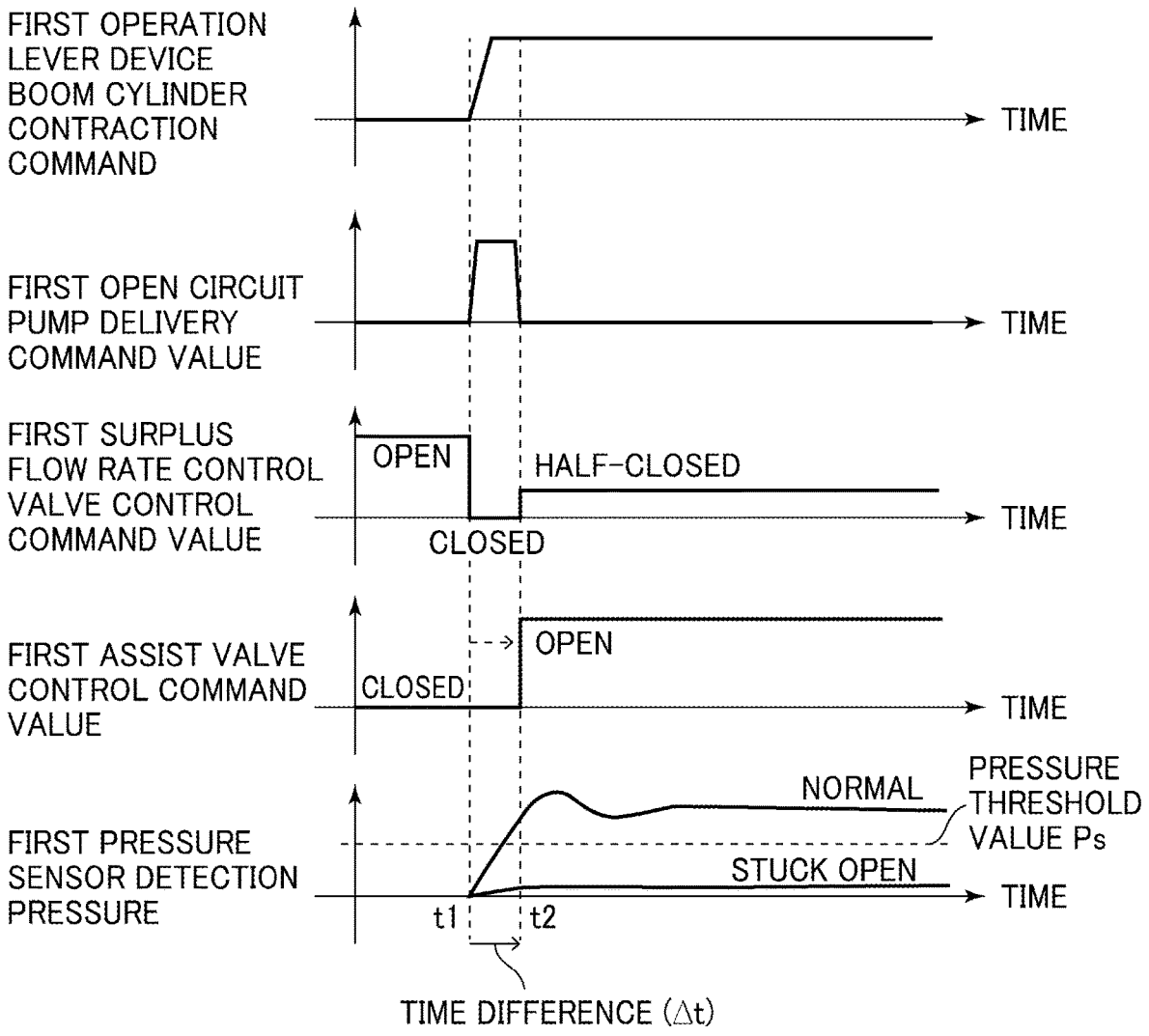
FIG. 6 is a characteristic chart illustrating an example of a chronological operation when the boom cylinder according to the first embodiment of the construction machine of the present invention performs a contracting operation.

Next, an example of a sticking detection method for the first surplus flow control valve 16 in a series of operations for driving the hydraulic actuator will be described with reference to FIGS. 5 and 6. FIG. 5 is a characteristic chart illustrating an example of a chronological operation when a boom cylinder according to the first embodiment of the construction machine of the present invention performs an expanding operation, and FIG. 6 is a characteristic chart illustrating an example of a chronological operation when the boom cylinder according to the first embodiment of the construction machine of the present invention performs a contracting operation.

First, the hydraulic circuit in the state in which the boom cylinder 1 is at rest will be described.

In the case where the first operation lever device 13 shown in FIG. 2 is in a non-operating state, the controller 14 inputs the operation amount signal of the first operation lever device 13 via the signal line. Based, for example, on a previously set table, the assist valve control section 14*c* outputs a closing signal to the first assist valve 15, and the surplus flow control valve control section 14*d* outputs an opening command to the first surplus flow control valve 16. In accordance with the operation amount, the pump delivery control section 14*e* reduces the pump delivery flow rate command value of the first closed circuit pump 11 and the first open circuit pump 12 to 0 and outputs the same. Since the delivery flow rate of the first closed circuit pump 11 and the first open circuit pump 12 is 0, and the first assist valve 15 is controlled to be in the interrupted state, the boom cylinder 1 comes to a stop.

Next, to be described will be the case where the boom cylinder 1 is expanded with the first surplus flow control valve 16 being stuck open.

FIG. 5 shows an example of the control signals and the pressure value of the line 202 in the case where the boom cylinder 1 is placed in the expanded state. In FIG. 5, the horizontal axes indicate time, and the vertical axes respectively indicate (a) the first operation lever device 13 boom cylinder expansion command, (b) the first open circuit pump 12 delivery command value, (c) the first surplus flow control valve 16 control command value, (d) the first assist valve 15 control command value, and (e) the first pressure sensor 18 detection pressure. Time t1 is the time when the first operation lever device 13 is operated, and time t2 is the time when the predetermined time difference (Δt) has elapsed since time t1.

When the operation amount command value for expanding the boom cylinder 1 is input from the first operation lever device 13, the operation amount detection section 14*a* of the controller 14 outputs the expansion drive command value to the surplus flow control valve control section 14*d*, the pump delivery control section 14*e*, and the assist valve control section 14*c* (time t1). Based on a previously set table, the surplus flow control valve control section 14*d* immediately outputs a totally closing signal as the control command value to the first surplus flow control valve 16, and the pump delivery control section 14*e* immediately outputs a control command signal respectively controlling the delivery flow rates of the first closed circuit pump 11 and the first open circuit pump 12, causing the working fluid to be delivered. At this time, based on the previously set table, the assist valve control section 14*c* continues to output a closing signal as the control command value to the first assist valve 15, and at time t2, when the predetermined time difference (Δt) has elapsed since time t1, outputs an opening command to the first assist valve 15.

The pressure detection section 14*b* of the controller 14 outputs the pressure signal of the line 202 to the sticking detection determination section 14*f*, and, in accordance with the characteristic chart of FIG. 5, the sticking detection determination section 14*f* compares the pressure of the line 202 with the previously determined threshold value Ps during the period of time in which time t2 of the predetermined time difference (Δt) is attained. When the pressure is higher than the threshold value Ps, it is determined that the first surplus flow control valve 16 is normal. On the other hand, in the case where the pressure is lower than the threshold value Ps, it is determined that the first surplus flow control valve 16 is stuck open.

Further, to be described will be the case where the boom cylinder 1 is contracted with the first surplus flow control valve 16 being stuck open.

FIG. 6 shows an example of the control signals and the pressure value of the line 202 in the case where the boom cylinder 1 is placed in the contracting operation state. In FIG. 6, the horizontal axes indicate time, and the vertical axes respectively indicate (a) the first operation lever device 13 boom cylinder contraction command, (b) the first open circuit pump 12 delivery command value, (c) the first surplus flow control valve 16 control command value, (d) the first assist valve 15 control command value, and (e) the first pressure sensor 18 detection pressure. Time t1 is the time when the first operation lever device 13 is operated, and time t2 is the time when the predetermined time difference (Δt) has elapsed since time t1.

When the operation amount command value causing the boom cylinder 1 to contract is input from the first operation lever device 13, the operation amount detection section 14*a* of the controller 14 outputs a contraction drive command value to the surplus flow control valve control section 14*d*, the pump delivery control section 14*e*, and the assist valve control section 14*c* (time t1). Based on a previously set table, the surplus flow control valve control section 14*d* immediately outputs a totally closing signal as the control command value to the first surplus flow control valve 16, and the pump delivery control section 14*e* immediately outputs a control command signal respectively controlling the delivery flow rate of the first closed circuit pump 11 and that of the first open circuit pump 12, and causes the working fluid to be delivered. At this time, the assist valve control section 14*c* continues to output a closing signal, and at time t2, when the predetermined time difference (Δt) has elapsed since time t1, outputs an opening command to the first assist valve 15.

The pressure detection section 14*b* of the controller 14 outputs the pressure signal of the line 202 to the sticking detection determination section 14*f*, and, in accordance with the characteristic chart of FIG. 6, the sticking detection determination section 14*f* compares the pressure of the line 202 with the previously determined threshold value Ps during the period of time in which time t2 of the predetermined time difference (Δt) is attained. When the pressure is higher than the threshold value Ps, it is determined that the first surplus flow control valve 16 is normal.

In this case, the pump delivery control section 14*e* outputs to the first open circuit pump 12 a control command signal reducing the delivery flow rate to 0, and the surplus flow control valve control section 14*d* adjusts the opening amount of the surplus flow control valve. For example, it outputs a half-closing signal to control the contraction speed of the boom cylinder 1. On the other hand, in the case where the pressure is lower than the threshold value Ps, the first surplus flow control valve 16 is determined to be in the stuck-open state.

Next, the effect of the present embodiment when expanding the boom cylinder 1 will be described.

For example, in the hydraulic circuit shown in FIG. 2, in the case where the first surplus flow control valve 16 operates normally without being stuck open, when the first operation lever device 13 is operated by the operator, the first surplus flow control valve 16 is closed in accordance with the command, and the first open circuit pump 12 delivers the working fluid. During the predetermined time difference (Δt) shown in FIG. 5, the first assist valve 15 is closed, so that the working fluid delivered from the first open circuit pump 12 is sealed in the line 202 in the closed state. Thus, the pressure in the line 202 is increased.

When the pressure in the line 202 increases to become higher than the pressure threshold value Ps shown in FIG. 5, the sticking detection determination section 14*f* determines that the first surplus flow control valve 16 is normal. Since the stop signal due to the stuck-open state is not input thereto from the sticking detection determination section 14*f* and the stop signal generating section 14*g*, the assist valve control section 14*c* outputs an opening command to the first assist valve 15 after the predetermined time difference (Δt) shown in FIG. 5 has elapsed. As a result, the working fluid delivered from the first open circuit pump 12 flows into the boom head 1*a*, making it possible to expand the boom cylinder 1 in accordance with the command of the first operation lever device 13.

On the other hand, in the case where the first surplus flow control valve 16 gets stuck open, when the first operation lever device 13 is operated by the operator, the first surplus flow control valve 16 receives a closing command, but remains open. Even if in this state the first open circuit pump 12 delivers the working fluid, and the first assist valve 15 remains closed during the predetermined time difference (Δt) shown in FIG. 5, the working fluid is discharged into the tank 17 via the first surplus flow control valve 16 stuck open. As a result, the pressure in the line 202 does not increase. Generally speaking, it is a low pressure akin to the pressure of the tank. In the case where the pressure in the line 202 is less than the pressure threshold value Ps shown in FIG. 5, the sticking detection determination section 14*f* determines that the first surplus flow control valve 16 is stuck open.

For example, in the case where no sticking detection determination section 14*f* is provided, assuming that an opening command is outputted to the first assist valve 15 after the predetermined time difference (Δt) shown in FIG. 5 has elapsed, the working fluid flows out of the boom head 1*a* since the pressure acting on the boom head 1*a* is higher than the pressure of the tank 17. As a result, unlike the case of the cylinder expansion command of the first operation lever device 13, the boom cylinder 1 is contracted. This results in deterioration of the operability of the construction machine and in a reduction in productivity. This is the same in the case where the operation to contract the boom cylinder 1 is performed.

In the present embodiment, in the case where the sticking detection determination section 14*f* determines that the first surplus flow control valve 16 is stuck open, the stop signal generating section 14*g* outputs a closing signal, for example, to the first assist valve 15 to interrupt the line 202, so that the working fluid from the boom head 1*a* is prevented from being discharged into the tank 17 via the first surplus flow control valve 16. This helps to prevent abrupt contraction of the boom cylinder 1. Further, each time the boom cylinder 1 is driven, the stuck-open state of the first surplus flow control valve 16 is checked in real time, so that it is possible to suppress a reduction in the operational efficiency of the construction machine.

In the first embodiment of the construction machine of the present invention, it is possible to detect the stuck-open state of the first surplus flow control valve 16 in real time during the operation of the construction machine, so that it is possible to suppress a reduction in operational efficiency.

It is possible to suppress a pressure shock generated when opening operation is performed on the first assist valve 15 through the same sequence as that of the present embodiment. More specifically, when expanding and contracting the boom cylinder 1, the first assist valve 15 is closed, and the working fluid is delivered from the first open circuit pump 12 in the state in which the first surplus flow control valve 16 is closed. After the pressure in the line 202 has been increased to a predetermined value, the first assist valve 15 is caused to perform opening operation. As a result, the pressure difference between the line 201 and the line 202 is previously diminished, so that it is possible to suppress the pressure shock generated when the first assist valve 15 performs opening operation. In this case, the predetermined pressure in the target line 202 is set to a pressure substantially equal to that of the boom head 1*a*. In contrast, the pressure Ps set in the embodiment of the present invention is a pressure of, for example, approximately 1 to 2 MPa, which is slightly higher than the pressure of the tank 17.

While in the present embodiment described above the drive object of the hydraulic cylinder is the boom only, this should not be construed restrictively. The present invention is applicable to the hydraulic cylinder of one of the boom, the arm, and the bucket.

Embodiment 2

Figure 7:
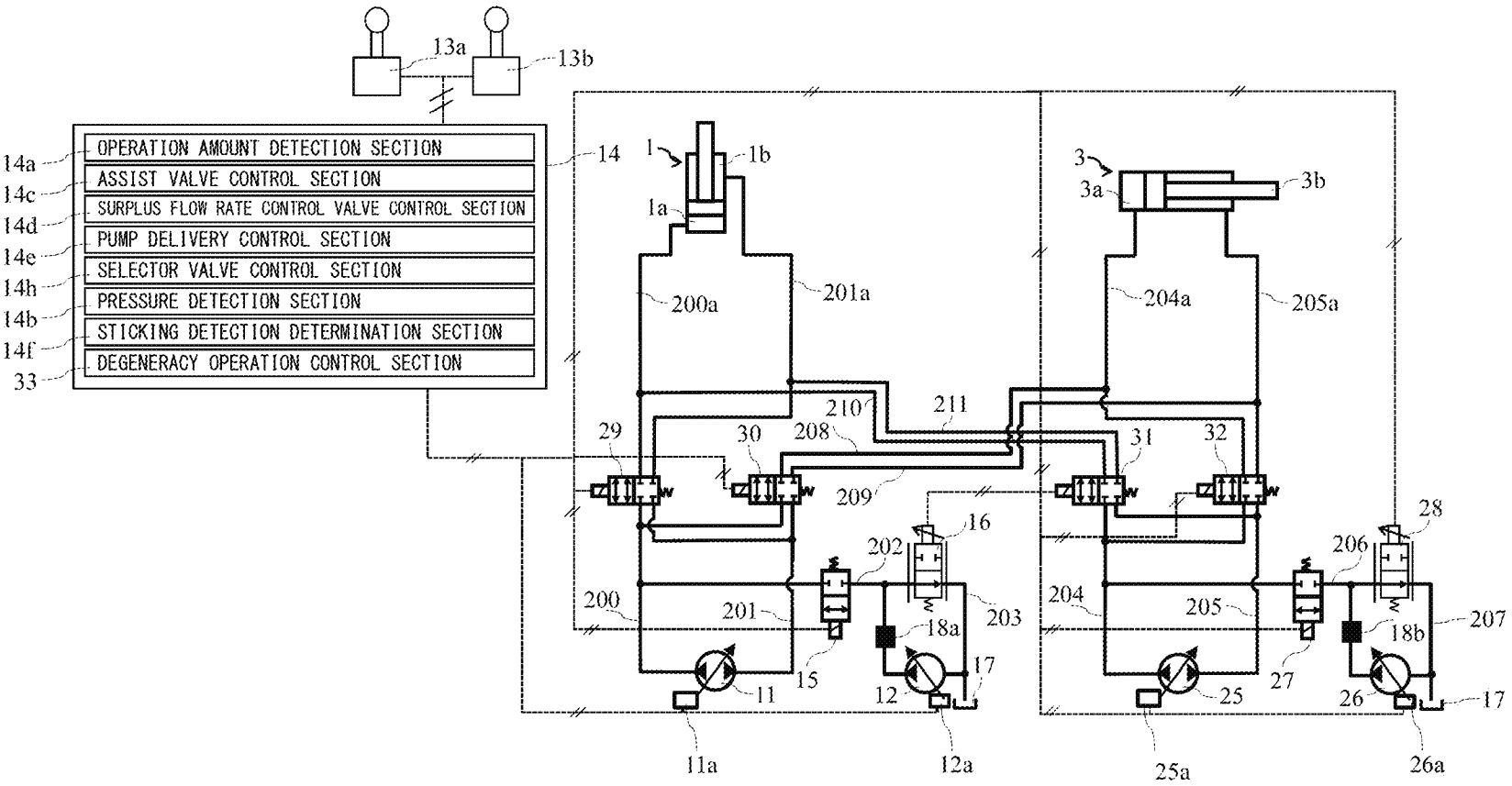
FIG. 7 is a schematic diagram illustrating a hydraulic drive system constituting a second embodiment of the construction machine of the present invention.
Figure 8:
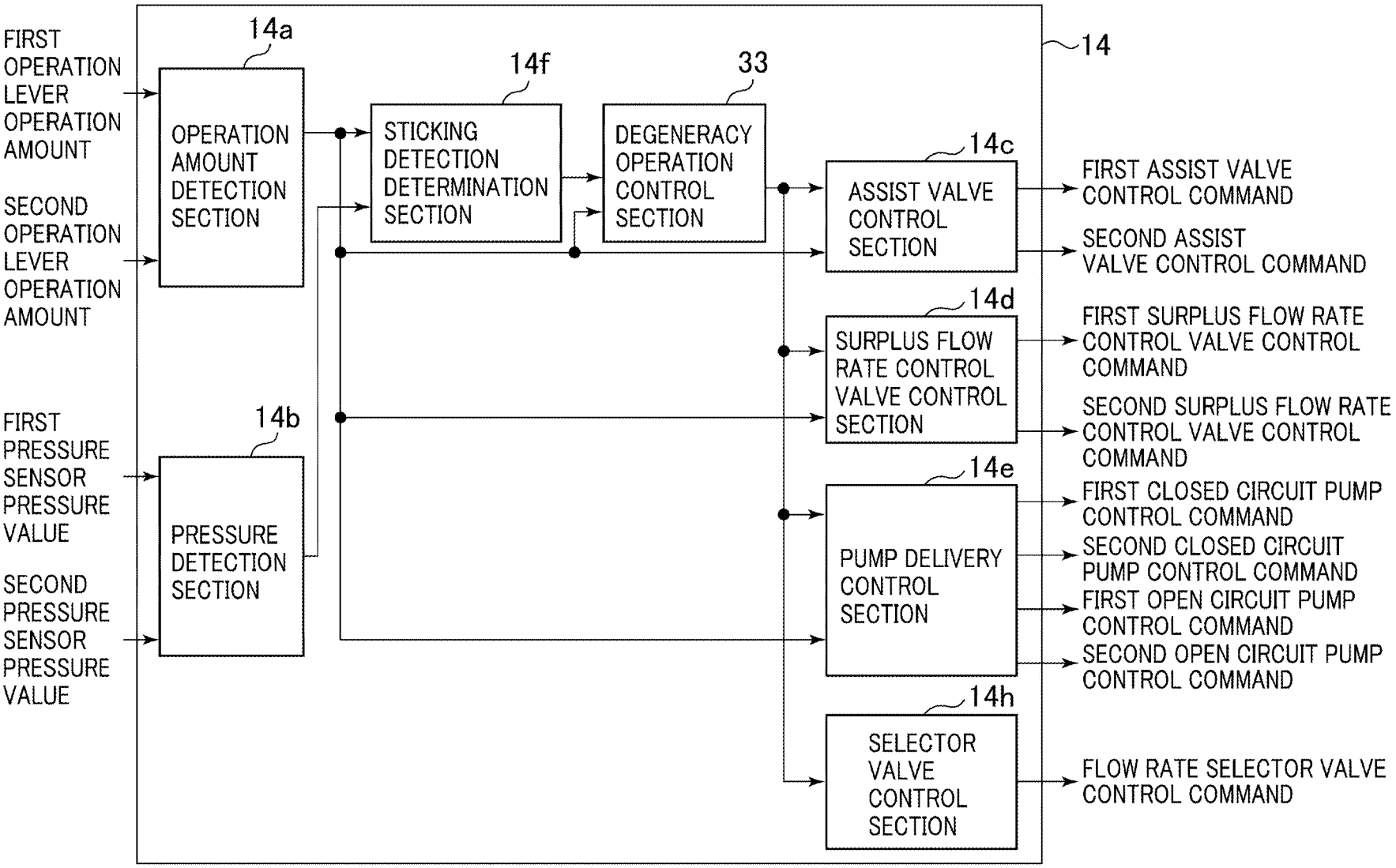
FIG. 8 is a conceptual drawing illustrating the structure of a controller constituting the second embodiment of the construction machine of the present invention.

In the following, the construction machine according to the second embodiment of the present invention will be described with reference to the drawings. FIG. 7 is a schematic diagram illustrating a hydraulic drive system constituting a second embodiment of the construction machine of the present invention, and FIG. 8 is a conceptual drawing illustrating the structure of a controller constituting the second embodiment of the construction machine of the present invention. In FIGS. 7 and 8, the components that are the same as those of FIGS. 1 through 6 are indicated by the same reference numerals, and a detailed description thereof will be left out.

In the present embodiment, there is provided a structure having: a plurality of hydraulic closed circuits in which the boom cylinder 1 and the arm cylinder 3 as the first and second hydraulic cylinders and the first and second closed circuit pumps 11 and 25 are connected in a closed-circuit-like fashion and the first and second open circuit pumps 12 and 26 are connected to the cylinder head side lines of the respective hydraulic closed circuits such that the boom cylinder 1 and the arm cylinder 3 are driven while the first and second closed circuit pumps 11 and 25 and the first and second open circuit pumps are respectively operated in conjunction with each other; and the first and second surplus flow control valves 16 and 28 in association with the first and second open circuit pumps. There is further provided a degeneracy operation function in which when the first and second surplus flow control valves 16 and 28 are stuck open, it is possible to drive the boom cylinder 1 or the arm cylinder 3 by a degeneracy operation control section 33 of the controller 14 without having to stop the construction machine.

Unlike the first embodiment, the present embodiment is further equipped with a second closed circuit unit equipped with the second closed circuit pump 25 and the second hydraulic cylinder 3 connected to the second closed circuit pump 25 in a closed-circuit-like fashion, and a second open circuit unit equipped with a second open circuit pump 26 connected to the head fluid chamber side line of the second hydraulic cylinder 3 via a second assist valve 27 which is a selector valve, and a second surplus flow control valve 28 arranged in a line branching off from the second open circuit pump delivery side line which is the line between the second open circuit pump and the second assist valve 27 and making it possible to discharge the working fluid from the head fluid chamber of the second hydraulic cylinder 3 into a tank.

Roughly speaking, the construction machine according to the second embodiment shown in FIG. 7 of the present invention is formed by apparatuses that are the same as those of the first embodiment. The differences are as follows.

In the present embodiment, there are provided a plurality of hydraulic closed circuits in which the boom cylinder 1 and the arm cylinder 3 as the first and second hydraulic cylinders are connected to the first and second closed circuit pumps 11 and 25, respectively. The first and second closed circuit pumps 11 and 25 and the first and second open circuit pumps 12 and 26 are driven by an engine (not shown), and each of them is equipped with a both-way tilting swash plate mechanism having a pair of input/output ports as the flow rate adjustment device, and a regulator 11*a*, 25*a*, 12*a*, 26*a* adjusting the inclination angle of the swash plate to adjust the pump displacement volume. The regulators 11*a*, 25*a*, 12*a*, and 26*a* respectively control the delivery flow rate of the first and second closed circuit pumps 11 and 25 and the delivery flow rate of the first and second open circuit pumps 12 and 26 each in accordance with a pump delivery flow rate command value received from the controller 14 via a signal line. There are provided a first operation lever device 13*a* for driving the boom cylinder 1, and a second operation lever device 13*b* for driving the arm cylinder 3.

In the present embodiment, there are provided line selector valves 29 through 32 as line selector circuits. One delivery port of the first closed circuit pump 11 is connected to the line selector valves 29 and 30 as line selector circuits via a line 200. By a signal from the degeneracy operation control section 33 of the controller 14 via a signal line, the line selector valves 29 and 30 are controlled in the circulation and switching direction of the line. In the case where there is no signal, they are controlled to the interruption state. The other delivery port of the first closed circuit pump 11 is connected to the line selector valves 29 and 30 via a line 201.

The line selector valve 29 is connected to the boom cylinder 1 via lines 200*a* and 201*a*. When the line selector valve 29 is placed in the circulation state, the first closed circuit pump 11 is connected to the boom cylinder 1 via the line. The line selector valve 30 is connected to the arm cylinder 3 via lines 208, 209, 204*a*, and 205*a*. When the line selector valve 30 is placed in the circulation state, the first closed circuit pump 11 is connected to the arm cylinder 3 via the lines.

Similarly, one delivery port of the second closed circuit pump 25 is connected to line selector valves 31 and 32 as line selector circuits via a line 204. By a signal from the degeneracy operation control section 33 of the controller 14 via a signal line, the line selector valves 31 and 32 are controlled in the circulation and switching direction of the line. In the case where there is no signal, they are controlled to the interruption state. The other delivery port of the second closed circuit pump 25 is connected to the line selector valves 31 and 32 via a line 205.

The line selector valve 31 is connected to the boom cylinder 1 via lines 210, 211, 200*a*, and 201*a*. When the line selector valve 31 is placed in the circulation state, the second closed circuit pump 25 is connected to the boom cylinder 1 via the lines. The line selector valve 32 is connected to the arm cylinder 3 via lines 204*a* and 205*a*. When the line selector valve 32 is placed in the circulation state, the second closed circuit pump 25 is connected to the arm cylinder 3 via the lines.

The delivery port of the first open circuit pump 12 is connected to the line 200 via the line 202 and the first assist valve 15 which is a selector valve, and the delivery port of the second open circuit pump 26 is connected to a line 204 via a line 206 and a second assist valve 27 which is a selector valve. Each of the lines 202 and 206 is provided with a branching portion, and connected to this branching portion is one end side of the line 203, 207 and the other end side of which is connected to the tank 17. The lines 203 and 207 are respectively provided with first and second surplus flow control valves 16 and 28. The line 202 and the line 206 are respectively provided with a first pressure sensor 18*a* and a second pressure sensor 18*b*. The delivery pressure signals of the first and second open circuit pumps 12 and 26, detected by the first and second pressure sensors 18*a* and 18*b* are input to the controller 14 via signal lines. Further, the operation signals of the first and second operation lever devices 13*a* and 13*b* operated by the operator are input to the controller 14 via signal lines.

Next, the controller 14 constituting the present embodiment will be described with reference to FIG. 8. The structure of the controller 14 of the present embodiment differs from that of the first embodiment in that there is additionally provided a selector valve control section 14*h* controlling the opening/closing of the line selector valves 29 through 32, and that the stop signal generating section 14*g* functions as the degeneracy operation control section 33.

The selector valve control section 14*h* inputs therein the expansion drive command value amount signal or the contraction drive command value amount signal of the boom cylinder 1 or the arm cylinder 3 from the operation amount detection section 14*a*. In the case where it is determined that one of the first and second surplus flow control valves 16 and 28 is stuck open, it inputs a control command signal described below from the degeneracy operation control section 33. In accordance with these signals, it outputs a control command driving the line selector valves 29 through 32.

The degeneracy operation control section 33 inputs the expansion drive command value amount signal or the contraction drive command value amount signal of the boom cylinder 1 or the arm cylinder 3 from the operation amount detection section 14*a*, and the stuck-open state determination flags of the first and second surplus flow control valves 16 and 28 from the sticking detection determination section 14*f*. In the case where the stuck-open state determination flag of one of the first and second surplus flow control valves 16 and 28 is input, the degeneracy operation control section 33 generates a control command value signal, and outputs it to each of the control sections 14*c* through 14*e* and 14*h*. For example, it generates the control command value signal and performs control so as to realize a cylinder drive control in accordance with the operation amount by using a normal surplus flow control valve without using the open circuit pump and the closed circuit pump connected to the surplus flow control valve stuck open.

Next, the operation when the first surplus flow control valve 16 shown in FIG. 7 gets stuck open in the present embodiment will be described.

As in the case of the first embodiment, when the first surplus flow control valve 16 gets stuck open when the boom cylinder 1 is expanded by the first operation lever device 13*a*, the detection pressure of the first pressure sensor 18*a* does not increase as in the case of the first embodiment shown in FIG. 5, so that the sticking detection determination section 14*f* determines that the first surplus flow control valve 16 has got stuck open, and outputs the stuck-open state determination flag of the first surplus flow control valve 16 to the degeneracy operation control section 33.

The degeneracy operation control section 33 outputs a command signal to the assist valve control section 14*c* and the selector valve control section 14*h*, and outputs a closing signal to the first assist valve 15 and the line selector valve 29 corresponding to the first open circuit pump 12.

Further, in the case where the expansion operation signal of the boom cylinder 1 is input from the first operation lever device 13*a* and where the operation signal driving the arm cylinder 3 is not input from the second operation lever device 13*b*, the degeneracy operation control section 33 outputs a command signal to the pump delivery control section 14*e*, and performs control such that the delivery flow rate of the second closed circuit pump 25 and that of the second open circuit pump 26 are in accordance with the operation amount of the first operation lever device 13*a*, outputting an opening operation signal to the second assist valve 27 and a closing signal to the second surplus flow control valve 28.

In the first embodiment described above, in the case where the first surplus flow control valve 16 gets stuck open, it is possible to stop the boom cylinder 1 by closing the first assist valve 15, making it possible to suppress an unintended operation of the boom cylinder 1. The boom cylinder 1, however, becomes incapable of driving, disadvantageously resulting in deterioration in operational efficiency. In such a case, in the present embodiment, the boom cylinder 1 is made capable of driving by using another closed circuit, so that it is possible to drive the boom cylinder 1 even if the first surplus flow control valve 16 gets stuck, making it possible to suppress deterioration in operational efficiency.

In the construction machine according to the second embodiment of the present invention, it is possible to attain the same effect as that of the first embodiment described above.

Further, in the construction machine according to the second embodiment of the present invention described above, even in the case where one surplus flow control valve gets stuck open, the hydraulic cylinder is made capable of driving by using another closed circuit, so that it is possible to suppress deterioration in operational efficiency.

While in the present embodiment described above the drive object of the hydraulic cylinder solely consists of the boom and the arm, this should not be construed restrictively. The present embodiment may be applied to the hydraulic cylinder of one of the boom, the arm, and the bucket.

Further, while in the present embodiment described above the boom cylinder 1 is driven in the case where the first surplus flow control valve 16 gets stuck open, this should not be construed restrictively. Also in the case where the arm cylinder 3 is expanded and contracted, the arm cylinder 3 may be driven by controlling the closed circuit pump, the open circuit pump, and the selector valve connected to the surplus flow control valve operating in the normal fashion.

Embodiment 3

Figure 9:
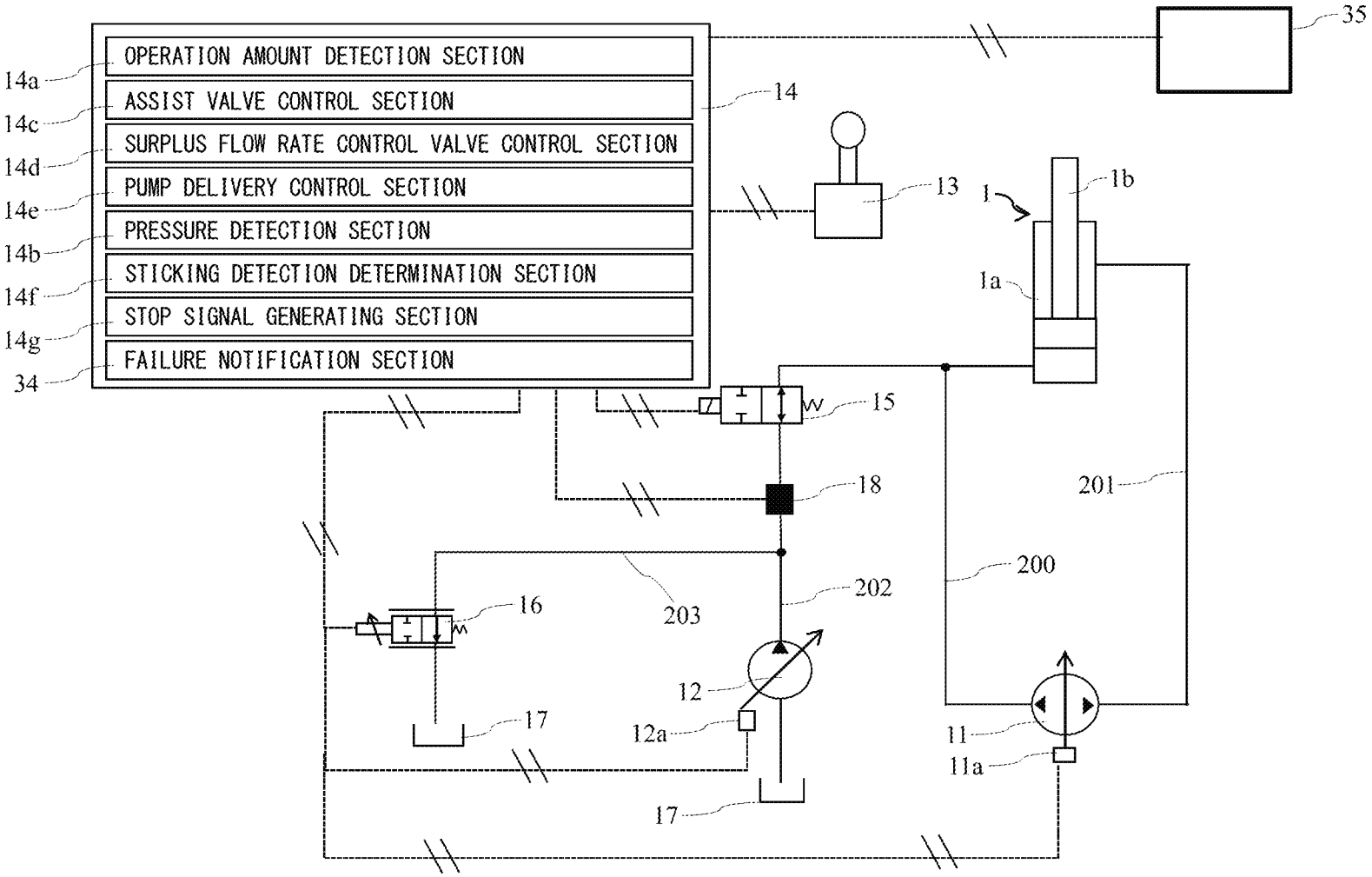
FIG. 9 is a schematic diagram illustrating a hydraulic drive system constituting a third embodiment of the construction machine of the present invention.
Figure 10:
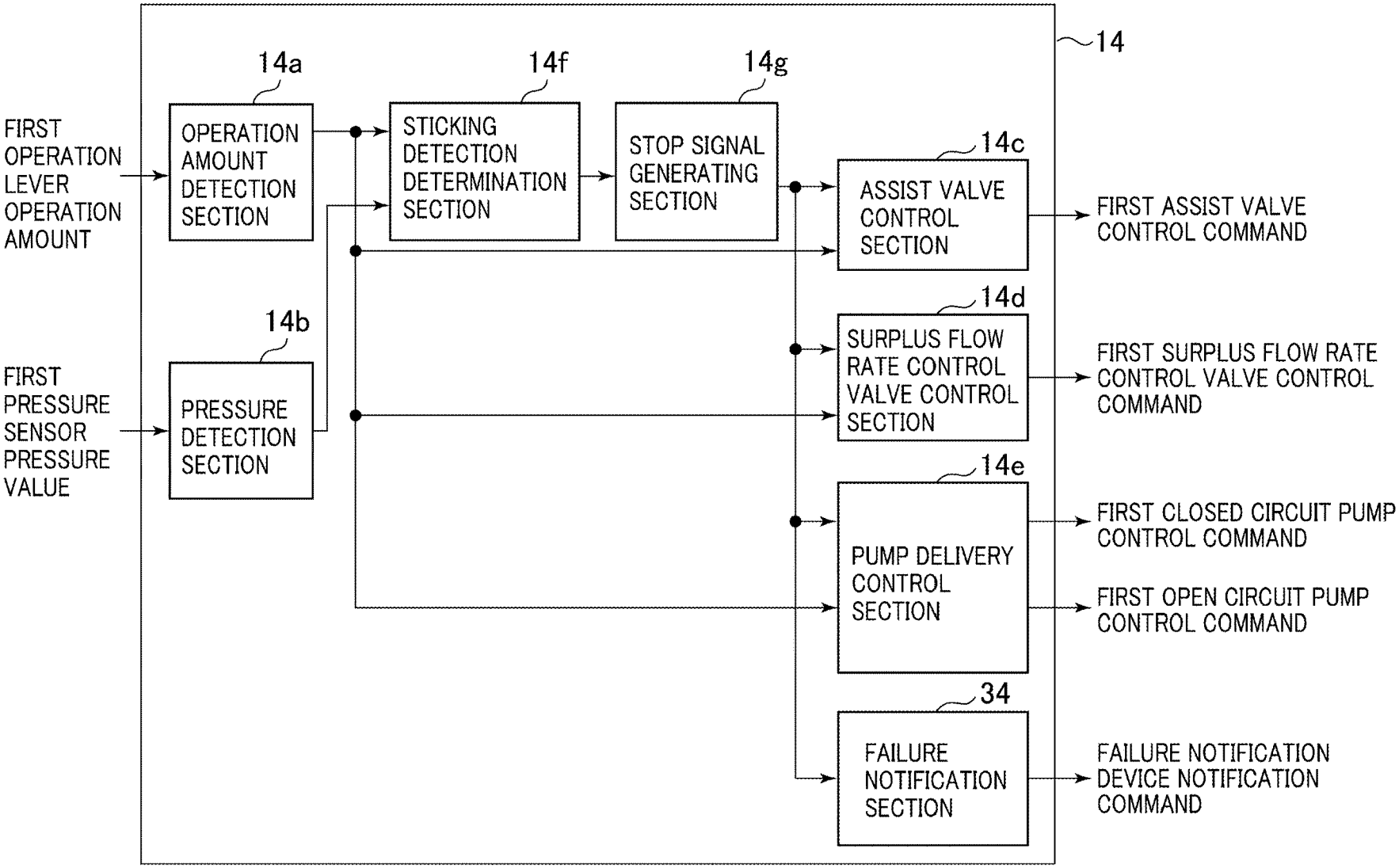
FIG. 10 is a conceptual drawing illustrating the structure of a controller constituting the third embodiment of the construction machine of the present invention.

In the following, the construction machine according to the third embodiment of the present invention will be described with reference to the drawings. FIG. 9 is a schematic diagram illustrating a hydraulic drive system constituting a third embodiment of the construction machine of the present invention, and FIG. 10 is a conceptual drawing illustrating the structure of a controller constituting the third embodiment of the construction machine of the present invention. In FIGS. 9 and 10, the components that are the same as those of FIGS. 1 through 8 are indicated by the same reference numerals, and a detailed description thereof will be left out.

Roughly speaking, the construction machine according to the third embodiment shown in FIG. 9 of the present invention is formed by the same apparatuses as those of the first embodiment except for the following differences.

In the present embodiment, the controller 14 is additionally provided with a failure notification section 34, and there is provided a failure notification device 35 connected to the controller 14 via a signal line.

As shown in FIG. 10, the failure notification section 34 receives a stuck-open state determination flag from the sticking detection determination section 14*f* via the stop signal generating section 14*g*, and, based on the value thereof, outputs information on the surplus flow control valve stuck open to the failure notification device 35. The information on the surplus flow control valve stuck open consists, for example, of the arrangement position and serial number of the surplus flow control valve out of order and the time of failure occurrence.

In the case where the first surplus flow control valve 16 shown in FIG. 9 gets stuck open, the failure notification section 34 of the controller 14 outputs information on the first surplus flow control valve 16 to the failure notification device 35, so that the operator or the maintenance technician can grasp the arrangement position and the failure condition of the surplus flow control valve out of order from the failure notification device 35.

In the construction machine according to the third embodiment of the present invention described above, it is possible to attain the same effect as that of the first embodiment described above.

Further, in the construction machine according to the third embodiment of the present invention described above, there are provided the failure notification section 34 and the failure notification device 35, so that in the case where the first surplus flow control valve 16 gets stuck open, it is possible to quickly notify the operator or the maintenance technician of detailed information on the surplus flow control valve out of order such as its position and the failure condition. This helps to shorten the requisite time for maintenance work such as component replacement. As a result, it is possible to shorten the period of time during which the construction machine is at rest and to achieve an improvement in terms of availability factor.

The failure notification device 35 may consist of a display section such as a display or sound notification means such as a speaker. Further, while in the present embodiment described above the stuck-open state of the first surplus flow control valve 16 is notified, it is possible to notify not only the stuck-open state but also a stuck-closed state in which the first surplus flow control valve 16 remains closed.

The present invention is not restricted to the above-described embodiments but includes various modifications without departing from the scope of the gist of the invention. For example, while in the embodiments described above the present invention is applied to a hydraulic excavator, the present invention is also applicable to construction machines other than a hydraulic excavator. For example, the present invention is applicable to construction machines in general equipped with a hydraulic device in which a work device drives a plurality of hydraulic actuators by a closed circuit such as a hydraulic crane.

DESCRIPTION OF REFERENCE CHARACTERS

1: Boom cylinder
1*a*: Boom head
1*b*: Boom rod
2: Boom
3: Arm cylinder
3*a*: Arm head
3*b*: Arm rod
4: Arm
5: Bucket cylinder
5*a*: Bucket head
5*b*: Bucket rod
6: Bucket
7: Swing hydraulic motor
8*a*, 8*b*: Track device
11, 25: First, second closed circuit pump
12, 26: First, second open circuit pump
11*a*, 25*a*, 12*a*, 26*a*: Regulator
13, 13*a*: First operation lever device
13*b*: Second operation lever device
14: Controller
14*a*: Operation amount detection section
14*b*: Pressure detection section
14*c*: Assist valve control section
14*d*: Surplus flow control valve control section
14*e*: Pump delivery control section
14*f*: Sticking detection determination section
14*g*: Stop signal generating section
14*h*: Selector valve control section
15, 27: First, second assist valve
16, 28: First, second surplus flow control valve
17: Tank
18, 18*a*: First pressure sensor
18*b*: Second pressure sensor
29 through 32: Line selector valve
33: Degeneracy operation control section
34: Failure notification section
35: Failure notification device
100: Hydraulic excavator
101: Cab
102: Upper swing structure
104: Front work device
200 through 211: Line
Ps: Threshold value

The invention claimed is:

1. A construction machine comprising:

a first closed circuit unit equipped with a first closed circuit pump, and a first hydraulic cylinder connected to the first closed circuit pump in a closed-circuit-like fashion;

a first open circuit unit equipped with a first open circuit pump connected to a head fluid chamber side line of the first hydraulic cylinder via a first assist valve that is a selector valve, and a first surplus flow control valve arranged in a line branching off from a first open circuit pump delivery side line that is a line between the first open circuit pump and the first assist valve, the first surplus flow control valve enabling a working fluid from a head fluid chamber of the first hydraulic cylinder to be discharged into a tank; and a control unit equipped with a first operation lever device directing an operation of the first hydraulic cylinder, a first pressure sensor measuring a pressure of the first open circuit pump delivery side line, a plurality of adjustment sections each adjusting delivery flow rates of the first closed circuit pump and the first open circuit pump, and a controller outputting command signals to the first surplus flow control valve, the first assist valve, and the plurality of adjustment sections, wherein the controller is equipped with:

a pressure detection section configured to take in a first pressure signal of the first open circuit pump delivery side line, measured by the first pressure sensor;

an operation amount detection section configured to take in an operation amount signal from the first operation lever device;

a surplus flow control valve control section configured to output a closing command to the first surplus flow control valve at an operation start when the operation amount detection section detects the operation amount signal of the first operation lever device;

a pump delivery control section configured to output a delivery flow rate command to the adjustment section of the first open circuit pump at the operation start;

an assist valve control section configured to output a closing command to the first assist valve at the operation start;

a sticking detection determination section configured to compare a first pressure signal from the pressure detection section with a previously set threshold value and determining that the first surplus flow control valve is in a stuck-open state when the first pressure signal is less than the threshold value and determining that the first surplus flow control valve is in a normal state when the first pressure signal exceeds the threshold value; and a stop signal generating section configured to input therein a sticking determination signal from the sticking detection determination section, output in a case of the stuck-open state a control signal maintaining the closed state of the first assist valve to the assist valve control section, and output in a case of the normal state a control signal causing the first assist valve to perform an opening operation to the assist valve control section.

2. The construction machine according to claim 1, further comprising:

a second closed circuit unit equipped with a second closed circuit pump, and a second hydraulic cylinder connected to the second closed circuit pump in a closed-circuit-like fashion; and a second open circuit unit equipped with a second open circuit pump connected to a head fluid chamber side line of the second hydraulic cylinder via a second assist valve that is a selector valve, and a second surplus flow control valve arranged in a line branching off from a second open circuit pump delivery side line that is a line between the second open circuit pump and the second assist valve, the second surplus flow control valve enabling a working fluid from a head fluid chamber of the second hydraulic cylinder to be discharged into a tank, wherein the first closed circuit unit and the second closed circuit unit have a plurality of line selector valves provided in lines connected to respective delivery sides of the first closed circuit pump and the second closed circuit pump, and selectively switching connection relationship between the first closed circuit pump, the second closed circuit pump, the first hydraulic cylinder, and the second hydraulic cylinder;

the control unit further has a second operation lever device directing an operation of the second hydraulic cylinder, a second pressure sensor measuring pressure of the second open circuit pump delivery side line, and a plurality of adjustment sections adjusting delivery flow rates of the second closed circuit pump and the second open circuit pump;

the controller is configured to output command signals to the second surplus flow control valve, the second assist valve, the plurality of line selector valves, and the plurality of adjustment sections;

the pressure detection section of the controller is configured to take in a second pressure signal of the second open circuit pump delivery side line, measured by the second pressure sensor;

the operation amount detection section of the controller is configured to take in an operation amount signal of the second hydraulic cylinder from the second operation lever device;

the surplus flow control valve control section of the controller is configured to output the closing command to the first surplus flow control valve connected to the first hydraulic cylinder at the operation start when the operation amount detection section detects the operation amount signal of the first hydraulic cylinder from the first operation lever device;

the pump delivery control section of the controller is configured to output, at the operation start, the delivery flow rate command to the adjustment section of the first open circuit pump connected to the first hydraulic cylinder;

the assist valve control section of the controller is configured to output, at the operation start, the closing command to the first assist valve connected to the first hydraulic cylinder;

the sticking detection determination section of the controller is configured to compare the first pressure signal from the pressure detection section with the previously set threshold value, to determine that the first surplus flow control valve connected to the first hydraulic cylinder is in the stuck open state when the first pressure signal is less than the threshold value, and determine that the first surplus flow control valve connected to the first hydraulic cylinder is normal when the first pressure signal exceeds the threshold value;

the stop signal generating section of the controller is configured to input therein the sticking determination signal from the sticking detection determination section, to output to the assist valve control section the control signal causing the first assist valve connected to the first hydraulic cylinder to open in the case of the normal state, and output to the assist valve control section the control signal maintaining the closed state of the first assist valve connected to the first hydraulic cylinder and a control signal causing the second assist valve connected to the second hydraulic cylinder to open in the case of the stuck-open state, functioning as a degeneracy operation control section outputting to the pump delivery control section a control signal increasing the delivery flow rate of the second open circuit pump connected to the second hydraulic cylinder; and there is further provided a selector valve control section inputting a control signal from the degeneracy operation control section and switching the plurality of line selector valves such that the working fluid delivered from the second open circuit pump connected to the second hydraulic cylinder flows into the first hydraulic cylinder.

3. The construction machine according to claim 1, further comprising a failure notification device connected to the controller via a signal line, wherein the controller has a failure notification section that inputs the sticking determination signal from the sticking detection determination section, and, in the case of the stuck-open state, transmits failure information on the first surplus flow control valve in the case of the stuck-open state; and the failure notification device is configured to notify an operator of the failure information on the first surplus flow control valve.

* * * * *